350-3.61 SR

XR 4,028,104

1 A 30326

United Stat

Graube

11] 4,028,104

45] June 7, 1977

[54] INFRARED HOLOGRAM RECORDING METHOD

[75] Inventor: Andrejs Graube, Venice, Calif.

[73] Assignee: Hughes Aircraft Company, Culver City, Calif.

[22] Filed: Apr. 21, 1975

[21] Appl. No.: 569,737

[52] U.S. Cl. ..... 96/27 H; 96/27 E; 96/45.2; 350/3.5

[51] Int. Cl.[2] ..... G03C 5/04; G03C 5/50

[58] Field of Search ..... 96/27 H, 45.2, 27 E; 350/3.5

[56] References Cited

UNITED STATES PATENTS

| | | | |
|---|---|---|---|
| 3,158,478 | 11/1964 | Eaton et al. | 96/45.2 |
| 3,178,997 | 4/1965 | Kelly | 96/27 H X |
| 3,556,631 | 1/1971 | Cook | 96/27 H |
| 3,642,477 | 2/1972 | Trusheim et al. | 96/45.2 |
| 3,685,997 | 8/1972 | Kellogg et al. | 96/45.2 |
| 3,811,885 | 5/1974 | Marchanr et al. | 96/27 E |

FOREIGN PATENTS OR APPLICATIONS

| | | | |
|---|---|---|---|
| 39-5512 | 4/1964 | Japan | 96/45.2 |

OTHER PUBLICATIONS

IBM Technical Disclosure Bull. vol. 13, No. 8 1/71 "Forming High Efficiency Holograms," Pennington et al. pp. 2282–2283.

Data Release by Kodak "Kodak Materials for Holography", 1969, pp. 1–10.

*Primary Examiner*—Mayer Weinblatt

*Attorney, Agent, or Firm*—B. T. Hogan, Jr.; W. H. MacAllister

[57] ABSTRACT

A process is disclosed whereby infrared holograms can be recorded in photographic silver halide emulsions as positive images. High resolution holograms have been produced with 1.06 μm radiation in photographic plates by utilizing the Herschel reversal effect.

7 Claims, 2 Drawing Figures

INFRARED HOLOGRAM RECORDING METHOD

BACKGROUND OF THE INVENTION

1. Field of the Invention

This invention is concerned with the field of optical recording systems in general. More particularly, it discloses a new Infrared Holographic recording method.

2. Prior Art

General interest in infrared holography has continued to grow in the last few years, despite the paucity of materials in this spectral region. Infrared holograms are known to be useful in infrared seeking missile systems, infrared communication system optics and infrared imaging for night vision image intensifiers.

Reviewing the current infrared materials, reported in literature, we find that the mechanisms of image formation generally fall into three classes: thermal, solid state, or photo-conductive effects.

Holograms have been recorded with IR radiation (0.75 to 1.5 $\mu$m) in many diverse materials. Photochromic spiropirans (T. Izawa and M. Kamiyama, Appl. Phys. Letters 15 (1969), pp. 201–203) and liquid crystals (W. A. Simpson and W. E. Deeds, Applied Optics 9 (1970), pp. 499–501; and F. Keilmann, Appl. Optics 9 (1970), pp. 1319–1322) are capable of recording low resolution interferograms by thermal processes with 10.6 $\mu$m $CO_2$ laser illumination. Silicon crystals (J. P. Woerdman, Optics Communications 2 (1970), pp. 212–214) can record transient holograms with Q-switched Nd: YAG laser pulses by the creation of free carriers. The ingenious photoconductor-thermoplastic devices (W. S. Colburn, L. M. Ralston and J. C. Dwyer, Appl. Phys. Letters 23, (1973), pp. 145–146) show sensitivity beyond 1 $\mu$m wavelengths and possess read-write-erase capability. Photographic emulsions (C. Roychoudhuri and B. J. Thompson, Optics Communications 10 (1974), pp. 23–25) can be dye-sensitized to 1.06 $\mu$m radiation, but they lack resolution characteristic of visible light (0.4–0.7 $\mu$m radiation) holographic plates. Dye sensitization of photopolymers (J. A. Jenney, J. Opt. Soc. Am. 60 (1970), pp. 115–1161) and dichromated gelatin (A. Graube, Optics Communications 8 (1973), pp. 251–253) have extended their spectral sensitivity to about 720 nm, but further infrared sensitivity is lacking.

All of the above materials, however, are unsatisfactory for recording holographic optical elements (HOE) when diffraction efficiency, spatial frequency, and permanence are considered.

The thermal effect materials typically suffer from a low resolution limit. This limit appears to result from the lateral conduction of heat through interference fringe boundries, and its extension beyond approximately 70 cycles/mm is highly improbable. Additionally, holograms formed in these materials have a very limited lifetime, and since the images are generally recorded as thick amplitude gratings, the diffraction efficiency is theoretically limited to approximately 3.7%. (J. C. Urbach, "Advances in Hologram Recording Materials," Developments in Holography, S.P.I.E. Seminar Proceedings, vol. 25, p. 17–41, April 14–15, 1971). Hence the thermal effect materials fall short in several catagories, and the possibility of substantially improving their characteristics is very remote.

In the solid state materials class silicon crystals have been included for the sake of completeness, but their application to HOE's is immediately preempted by the short persistence time (i.e., 25 nsec) of the holographic image. The photographic emulsion can be dye sensitized to respond to wavelength exceeding 1.1 microns. (C. E. K. Mees and T. H. James, *The Theory of the Photographic Process*, Macmillan Co., New York, 1966., Ch. 12). This long wavelength sensitization, however, is restricted to relatively large silver halide crystals, which severely limit the resolution of the film. The 4-Z plate is Kodak's newest near infrared product, but the spatial frequency is limited to less than 25 cycles/mm.

The thermoplastic material utilizes the photoconductive effect to initiate the image recording process. The actual image is recorded in a thermoplastic with the aid of a xerographic surface charge. (L. H. Lin and H. L. Beauchamp, Appl. Opt. 9 (1970) 2088–2092). Exposures with 1.15 micron radiation produce up to 5% diffraction efficiency, but the efficiency drops to 0.15% at a spatial frequency of 1000 cycles/mm. (W. S. Colburn, L. M. Ralston, and J. C. Dwyer, Appl. Phys. Letters 23 (1973) 145–146). Unfortunately, since the holograms are recorded as thin phase images, the theoretical maximum diffraction efficiency is limited to 33.9% (See Unbach Supra).

In seeking to overcome the limitations discussed above and bringing near infrared HOE's closer to reality, it was discovered that holographic images can be recorded in photographic emulsions by utilizing the Herschel effect.

In 1840, Sir John Herschel discovered that latent images recorded in photographic emulsions could be selectively erased by irradiation at infrared wavelengths (Sir J. F. W. Herschel, Philosophical Transactions (1840) pp. 1–59). This phenomenon is called the Hershel reversal effect. It has been applied to various photographic processes for making direct positive prints or copies. However, processes employing this principle required comparatively large illumination energies. These processes differed from that employed in the fabrication of holograms in that conventional light sources were used and generally nontransparent prints or copies were obtained.

THE INVENTION

Summary

A method of fabricating superior holograms with infrared radiation which utilizes old photographic principles to overcome the disadvantages and limitations of the prior art holographic processes discussed above has been discovered.

The method utilizes the Herschel effect to extend the spectral sensitivity of certain Silver Halide emulsions to infrared wavelengths.

Specific films prepared by Kodak and Agfa, are exposed to visible light prior to infrared holographic exposure whereby the Herschel effect renders them sensitive to infrared exposure. They may, subsequent to infrared exposure, then be conventionally developed and bleached to achieve permanence.

Holograms prepared by this process have high resolution that is characteristic of visible light holographic plates and they have exhibited diffraction efficiencies higher than any known infrared holographic material.

DETAILED DESCRIPTION

Figure 1:
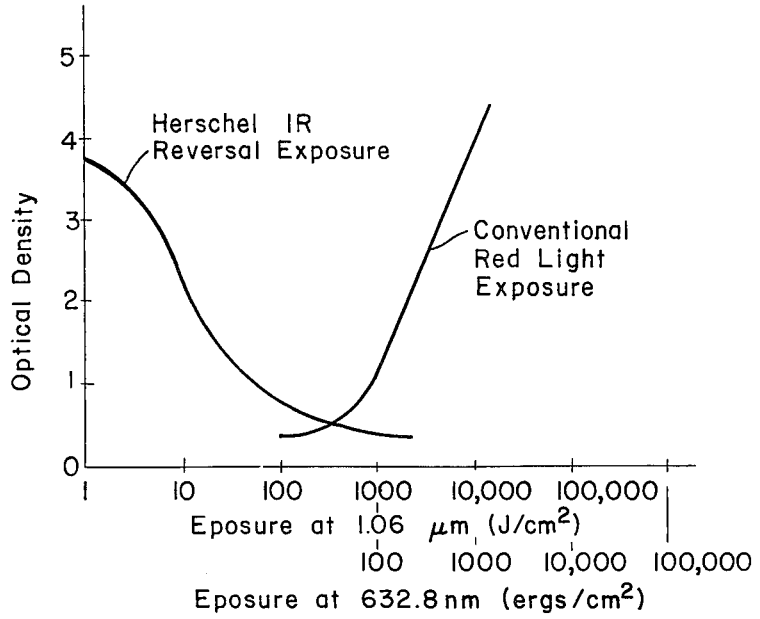
FIG. 1 compares the H and D curves for Kodak 120–01 holographic plates with Herchel reversal at 1.06 μm and with conventional exposure at 632.8 nm.

The utility of infrared (IR) holograms is well established. The elimination or minimization of the limitations inherent in the prior art processes for the fabrication of IR holograms discussed above will increase the utility of IR holograms and extend the range of potential applications.

One objective of this invention is to devise a method of producing IR holograms which exhibit high diffraction efficiencies; another object is to produce positive image holograms exhibiting permanence; another object is to produce IR holograms with minimal scattering effects in the 1.06 micron wavelength region with large index modulations; and a still further objective is to produce IR holograms exhibiting high spatial frequency response characteristics.

In seeking to achieve the above objectives, we have found that in a photographic plate which is uniformly exposed to white light (light containing all visible light wave lengths), subsequently exposed to the interference pattern of an infrared (0.75–1.5 μm radiation) laser, then a positive diffraction grating is produced upon development. The image can then be bleached to give a permanent, high diffraction efficiency, thick, phase hologram corresponding to the coherent IR exposure. Inasmuch as the photographic plates employed were not sensitive to 0.75–1.5 μm (IR) IR radiation prior to their exposure to the white light, the effect produced is attributed to the Herschel effect produced upon exposure to the white light.

The following explanation of the Herschel reversal effect in photographic processes has been proposed (R. W. Gurney and N. F. Mott, Proc. Roy. Soc. 164 (1938), p. 151). When an exposed photographic emulsion absorbs long wavelength radiation, an electron is elevated to the conduction band in the silver halide crystal. This loss of electrons by silver particles constitutes destruction of the latent image, and leads to a decreased optical density after photographic development.

The Herschel effect at any particular wavelength is influenced by a multitude of factors, including emulsion additives and spectral sensitizing dyes (C. E. K. Mees and T. H. James, *The Theory of the Photographic Process*, Third Edition, The Macmillan Company, New York (1966), pp. 155–160). Since it is not easy to predict which commercially-available emulsions exhibit the strongest Herschel effect, we tried several popular photographic plates. The exposing IR source was a cw Nd: YAG laser (GTE Sylvania Model 605) filtered through 1.06 μm interference filter. The various photographic plates were prepared and processed in the following manner:

1. Expose plate to a 100W incandescent bulb at a distance of approximately 40/cm for 10 sec.
2. Expose part of the plate to 1.06 μm radiation to give a total exposure of 9,000 J/cm².
3. Develop:
   a. Kodak D-19 developer, 5 min.
   b. Acid stop, 30 sec.
   c. Kodak rapid fixer with hardener, 10 min.
   d. Water wash, 10 min.
   e. Kodak Photo-Flo 200, diluted 1:200, 30 sec.
   f. Dry in ambient air.

The optical density reduction in the IR exposed region was measured and compared to the IR unexposed region as shown in Table I.

TABLE 1

| OPTICAL DENSITY MEASUREMENTS | | |
|---|---|---|
| Plate Type | O.D. Without IR Exposure | O.D. With IR Exposure |
| Kodak 120-01 | 4.40 | 0.302 |
| Agfa 10E56 | 4.56 | 3.43 |
| Agfa 10E75 | 4.39 | 0.886 |

Further IR exposures on the Kodak 120–01 plates showed that detectable O.D. erasures could be accomplished with less than 1.5 J/cm². FIG. 1 shows the H and D curves for Kodak 120–01 plates for direct visible and reversal IR exposures. To eliminate the possibility that the observed density reversals were due to a small amount of inherent IR sensitivity coupled with the solarization effect, (Ibid, pp. 150–154) we adjusted the visible light pre-exposure to give a developed density of about 4, which is approximately in the middle of the straight line portion of the regular H and D curve. Any decrease in developed density then directly results from the IR exposure via the Herschel effect.

Figure 2:
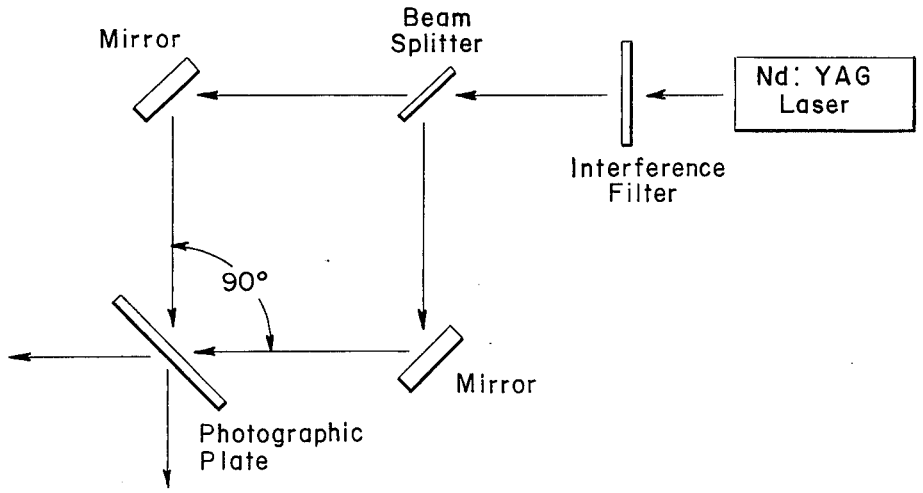
FIG. 2 presents a typical optical arrangement for exposing infrared holograms.

We also made holographic exposures by Herschel reversal in Kodak 120–01 plates. FIG. 2 shows the exposure apparatus used. For stability, the beam splitter, mirrors and plate holder were all attached to a solid aluminum block, and the beam path lengths were matched to within 2 mm. The laser was apertured down to give a single, unpolarized, transverse mode.

Judging from the recorded spatial frequency of the interference fringes produced in the developed plate of over 1300 cycles/mm, we believe that the modulation transfer function for the Herschel IR reversal recording is probably comparable to that achieved in visible light exposures. (A. Graube, Appl. Optics 13 (1974), pp. 2942–2946).

Following the coherent IR exposures and conventional development, the amplitude gratings were bleached with bromine vapor and the diffraction efficiencies were measured with a 632.8 nm He-Ne laser. With average IR exposures of 4000 J/cm² over a period of 2000 sec., the highest efficiency (i.e., percent of incident light diffracted into the first order) achieved was 25%, corresponding to an effective index modulation of about 0.02. This diffraction efficiency is the highest value reported in any IR holographic material. We believe that higher diffraction efficiencies can be obtained with visible and IR exposure optimization, further vibrational isolation of the optical system, and the use of polarized exposing laser beams.

Generally one may utilize white light at a distance of 40 to 56 cm or exposure to sun light for from 5 to 15 seconds to obtain the Herschel effect prior to IR exposure and the IR exposure may be from 0.75 to 1.5 μm radiation producing a total exposure of from 4000 to 10,000 J/cm².

After exposure, the plates may be developed in a conventional manner. For example, Kodak developers such as HRP as well as D-19 may be applied for from 3–5 minutes.

The acid stop, rapid fix and water wash time intervals may vary from 20 to 60 seconds, 5 to 10 minutes and 5 to 15 minutes respectively.

We utilized step 3*e* above to preclude water spot formation during the subsequent drying step. However, this step may not be necessary in all processes.

An exciting aspect of this holographic technique is that photographic emulsions having very fine grains can be employed. In TABLE 2, infrared holographic materials prepared via this process are compared with other IR holographic materials. It should be noted that the 25% diffraction efficiency shown was achieved at an actual spatial frequency of 1334 cycles/mm. In contrast, the next best prior art (Item c) yielded a diffraction efficiency of only 5% at an actual spatial frequency of 520 cycles/mm. While we have not yet performed the experiments, we expect that out diffraction efficiency and spatial frequency limits are much higher.

SPECIFIC EXAMPLES

I. The preferred method is comprised of the following steps:

1. Uniformly expose a Kodak 120-01 photographic plate to the white light of a 100 watt incandescent bulb for 10 seconds at a distance of 2 feet.

2. Expose the plate to the interferring beams of a Nd: YAG laser (i.e., 1.06 micron wavelength light) to give a total exposure of 4,000 Joules/cm$^2$.

3. Develop by a conventional method. For example, apply Kodak HRP developer for 3 seconds, acid step 30 seconds, apply Kodak Rapid Fixer for 5 minutes, water wash 10 minutes and air dry, and 4. Bleach by placing the dried plate in a container filled with bromine vapor for 20 minutes. The resulting plate will contain a high efficiency, thick, phase hologram corresponding to the coherent infrared exposure made in step 2.

II. Substitute a Kodak 649-F plate for the plate employed in Step 1 of Example I followed by steps 2 through 4 of Example I.

III. Substitute a Kodak 649-O plate for the plate employed in Step 1 of Example I followed by Step 2 through 4 of Example 4.

Having fully described the invention and described how to make and use the invention, the scope of my claims to this process may now be understood.

What is claimed is:

1. A method of fabricating infrared holograms from silver halide emulsion photographic plates or films comprising, first exposing said plates to visible light, second uniformly exposing said plates or films to holographic infrared radiation and developing said exposed plates or films.

2. A method of fabricating infrared holograms exhibiting high diffraction efficiencies and high spatial frequencies from photographic plates or films comprised of the steps of claim 1 plus the additional step of bleaching said exposed plates or films.

3. The method of claim 2 wherein said bleaching step is achieved by exposing said exposed plates or film to bromine vapors.

4. The method of claim 2 wherein said white light is obtained from an incandescent bulb, and said infrared radiation is obtained from a Nd; YAG laser producing 1.06 $\mu$m wavelength radiation.

5. A method of fabricating infrared holograms comprising the steps of:

a. uniformly exposing a photographic plate or film, comprised of a silver halide emulsion, to visible light whereby the sensitivity of said film or plate is extended to $1 + 0.25$ $\mu$m wavelength range, b. subsequently subjecting said plate or film to a holographic infrared radiation exposure until the desired optical density reduction is achieved, and c. developing said exposed plate.

6. A method of fabricating infrared holograms exhibiting high diffraction efficiencies and high spatial frequencies comprised of the steps of claim 5 plus the subsequent step of bleaching said developed plate via exposing said plate bromine vapors.

7. The method of claim 6 wherein said visible light is obtained from an incandescent bulb, and said infrared radiation is obtained from an Nd: YAG laser producing 1.06 $\mu$m wavelength radiation.

* * * * *

UNITED STATES PATENT AND TRADEMARK OFFICE

CERTIFICATE OF CORRECTION

PATENT NO. : 4,028,104

DATED : June 7, 1977

INVENTOR(S) : Andrejs Graube

It is certified that error appears in the above-identified patent and that said Letters Patent are hereby corrected as shown below:

Column 6, line 31 (in Claim 5) the term "1 + 0.25 μm" should read "1 ± 0.25 μm"

Column 6, line 40 (in Claim 6) after "plate" insert "to"

Signed and Sealed this

*Seventh* Day of *November 1978*

[SEAL]

*Attest:*

RUTH C. MASON
*Attesting Officer*

DONALD W. BANNER
*Commissioner of Patents and Trademarks*